United States Patent [19]

Hamburg

[11] Patent Number: 4,641,623

[45] Date of Patent: Feb. 10, 1987

[54] ADAPTIVE FEEDFORWARD AIR/FUEL RATIO CONTROL FOR VAPOR RECOVERY PURGE SYSTEM

[75] Inventor: Douglas R. Hamburg, Birmingham, Mich.

[73] Assignee: Ford Motor Company, Dearborn, Mich.

[21] Appl. No.: 759,724

[22] Filed: Jul. 29, 1985

[51] Int. Cl.[4] ..... F02B 33/00

[52] U.S. Cl. ..... 123/518; 123/520; 123/440

[58] Field of Search ..... 123/518, 520, 489, 440

[56] References Cited

U.S. PATENT DOCUMENTS 4,318,383 3/1982 Iritani ..... 123/520

4,527,532 7/1985 Kasai ..... 123/520

*Primary Examiner*—Ronald B. Cox

*Attorney, Agent, or Firm*—Peter Abolins; Robert D. Sanborn

[57] ABSTRACT

Controlling air/fuel ratio perturbations in response to purging of fuel vapors from a vapor canister storing fuel vapors from the fuel tank of an internal combustion engine includes feeding forward an offsetting fuel command signal. The feedforward offsetting fuel command signal is used to change, and thereby compensate, a base fuel command signal applied to a fuel injector controller whenever fuel vapor purging is occurring.

10 Claims, 4 Drawing Figures

ADAPTIVE FEEDFORWARD AIR/FUEL RATIO CONTROL FOR VAPOR RECOVERY PURGE SYSTEM

BACKGROUND OF THE INVENTION

1. Field of the Invention

This invention relates to a control device for variably controlling a purge of fuel vapors from a storage canister into an automotive type internal combustion engine.

2. Prior Art

Carbon canister storage systems are known for storing fuel vapors emitted from an automotive-type fuel tank for carburetor float bowl or other similar fuel reservoir, to prevent emission into the atmosphere of fuel evaporative components. These systems usually include a canister containing activated carbon with an inlet from the fuel tank or other reservoir so that when the fuel vaporizes, the vapors will flow either by gravity or under vapor pressure into the canister to be adsorbed by the carbon therein stored. Filling the fuel tank with fuel may displace fuel vapors in the fuel tank and drive them into the canister. Subsequently, in most instances, the purge line connected from the canister outlet to the carburetor or engine intake manifold purges the stored vapors into the engine during engine operation. The canister contains a purge fresh air inlet to cause a sweep of the air across the carbon particles to thereby desorb the carbon of the fuel vapors.

In most instances, a purge or nonpurge of vapors is an on/off type of operation. That is, either the purge flow is total or zero. For example, U.S. Pat. No. 3,831,353 to Toth teaches a fuel evaporative control system and associated canister for storing fuel vapors and subsequently purging them back into the engine air cleaner. However, there is no control valve mechanism to vary the quantity of purge flow. As soon as the throttle valve is open, the fuel vapors are purged continuously into the manifold.

U.S. Pat. No. 4,326,489 to Heitert teaches a fuel vapor purge control device that controls a vacuum servo mechanism connected to a valve member that is slidable across a metering slot to provide a variable flow area responsive to changes in engine intake manifold vacuum to accurately meter the re-entry of fuel vapors into the engine proportionate to engine airflow.

U.S. Pat. Nos. 4,013,054; 4,275,697; 4,308,842; 4,326,489 and 4,377,142 disclose fuel purging systems incorporating some form of air/fuel ratio control but include no provision for applying a sequence of time varying pulses to the solenoid purge control valve.

As described, typical onboard refueling vapor recovery systems use an activated carbon canister to store the gasoline vapors which are displaced when refueling of the vehicle is performed. These vapors are subsequently purged from the system by passing air through the canister and into the engine, thereby causing a potential enrichment of the engine's air/fuel ratio and an increase in the engine's emissions, such as carbon monoxide and hydrocarbon. Such undesirable effects of purging can be reduced with present day fuel systems which employ feedback from an EGO sensor in the engine's exhaust to regulate the air/fuel ratio. Unfortunately, air/fuel ratio feedback cannot instantaneously reduce the air/fuel perturbations which result from abrupt changes in purging because of the inherent propagation time delay through the engine and exhaust system. As a result, there will always be short periods of uncontrolled air/fuel perturbations whenever the refueling vapor purge flow changes abruptly, such as at the beginning or end of a purge command signal. An abrupt increase of a vapor filled purge, such as that from a vapor filled canister, can cause an undesirably rich air/fuel ratio. On the other hand, an abrupt decrease with a substantially air filled purge, such as that from a vapor free canister, can also cause an undesirably rich air/fuel ratio.

It would be desirable to eliminate uncontrolled air/fuel perturbations whenever the refueling vapor purge flow changes abruptly. These are some of the problems this invention overcomes.

SUMMARY OF THE INVENTION

In accordance with an embodiment of this invention, air/fuel ratio perturbations are substantially eliminated by feeding forward an offsetting fuel command signal which can be used to instantly change the commanded base fuel signal to the fuel injector controller whenever fuel vapor purging is occurring. Advantageously, the value of the offsetting fuel command is approximately proportional to the amount of gasoline vapors stored in the carbon canister (i.e. the canister charge). Since refueling of the vehicle's fuel tank is what actually charges the canister, a simple indicator of the canister charge state is the level of gasoline in the vehicle's fuel tank (i.e. the signal output of the gasoline fuel gauge). As a result, when the fuel tank is full and the canister is fully charged, a relatively large offsetting fuel command would be generated during canister purging and would be fed forward to the fuel controller to reduce the base fuel command in response to the extra fuel being supplied by the purge line.

As the level of gasoline in the fuel tank decreases, the magnitude of the offsetting fuel/air command is gradually reduced to adapt to the decreased fuel being supplied during purging. Furthermore, when the level of gasoline in the fuel tank decreases to values indicating that the canister is nearing complete depletion, the polarity of the fuel command would be reversed to provide an enriched engine fuel flow to compensate for the leaning effect of the purge air which, in this case, does not contain much fuel vapor.

DETAILED DESCRIPTION OF THE INVENTION

Figure 1:
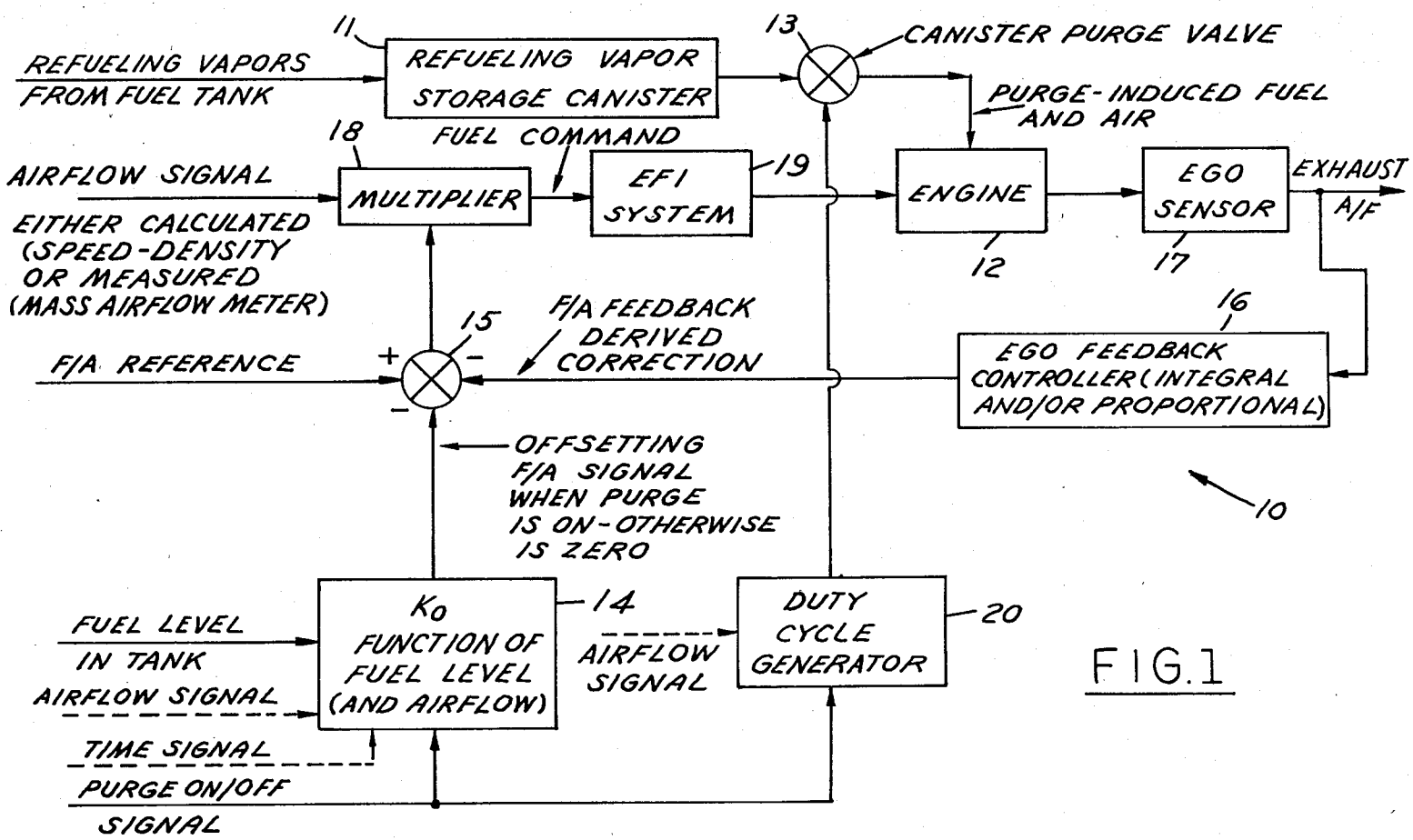
FIG. 1 is a block diagram of a typical air/fuel ratio control system with feedforward correction for purge-induced air/fuel ratio perturbations.
Figure 3:
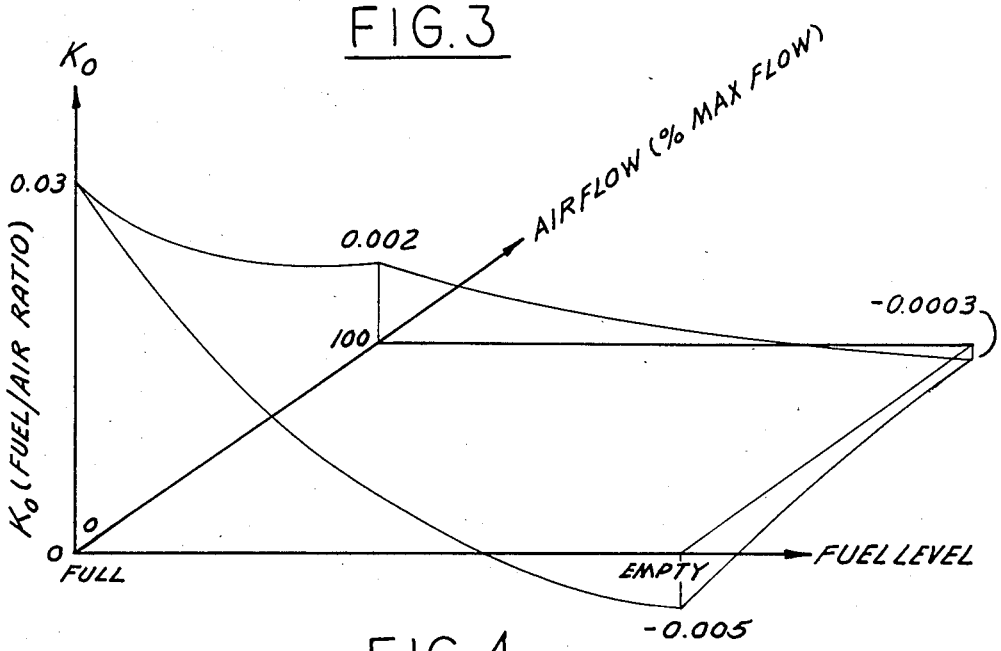
FIG. 3 is a graphical representation of a multiplication factor, $K_0$ as a function of fuel level and airflow for use in block 14 of FIG. 1.

Referring to FIG. 1, a vapor recovery purge system 10 includes a refueling vapor storage canister 11 which receives refueling vapors from a fuel tank and purges the vapors to an engine 12 through a canister purge valve 13. A purge on/off signal is applied to canister purge valve 13 and also to a block 14 which also receives a signal indicating the fuel level in the fuel tank. Block 14 applies a proportionality factor, $K_0$, which is a function of the fuel level to the purge on/off signal and can also be a function of air flow. A graphical representation of a typical $K_0$ as a function of airflow and fuel level is shown in FIG. 3. The resulting output signal from block 14 is applied to a summer 15 which also receives as a second input a reference signal indicating desired fuel/air and as a third input an output from an exhaust gas oxygen feedback controller 16. Controller 16 generates a base fuel command in accordance with any number of known engine control systems. An exhaust gas oxygen sensor 17 detects the air/fuel ratio of the exhaust from engine 12 and applies a signal to exhaust gas oxygen feedback controller 16. The output from summer 15 is applied to a multiplier 18 which also receives a signal indicating air flow. Multiplier 18 acts to calculate fuel command using corrected fuel/air and current airflow in accordance with the relationship: fuel flow=(fuel/air)×airflow. The air flow signal can either be calculated using a speed density calculation or measured using a mass air flow meter. The output from multiplier 18 is applied as a fuel command to a fuel control system 19, such as an electronic fuel injection (EFI) system, which then determines the amount of fuel applied to engine 12.

Figure 4:
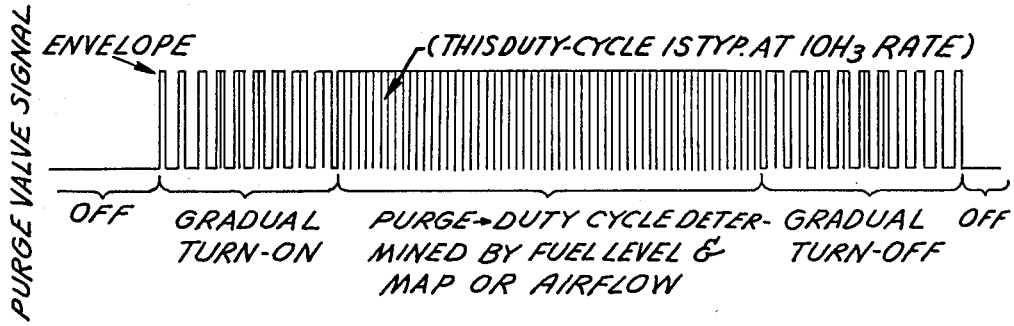
FIG. 4 is a graphical representation of a purge valve signal using a variable duty cycle for use in connection with duty cycle generator 20 of FIG. 1.

Referring to FIG. 1, the purge on/off signal is applied to canister purge valve 13 through a duty cycle generator 20. A typical purge valve signal is shown in FIG. 4. Duty cycle generator 20 provides a variable duty cycle so that the transition between full purge and no purge is done gradually in order to control emissions. That is, the purge flow of an air/fuel vapor mixture is modulated as it flows from the vapor canister to the intake of the internal combustion engine by gradually changing the magnitude of the transient flow between no purge flow and full purge flow so that the amount of combustion exhaust emissions are controlled. The solenoid in the flow path from the vapor canister to the intake of the internal combustion engine is selectively actuated and the duty cycle of the actuating signal is changed to control the magnitude of the average flow through the solenoid control valve. The particular duty cycle chosen can be predetermined to respond to the purge on/off command signal or can be a function of various engine operating parameters.

In operation, the value of the offsetting fuel command in block 14, $K_0$, is set in response to the output of the vehicle's fuel gauge sending unit. Thus, when purging occurs, an appropriate offsetting fuel command is subtracted from the normal system base fuel command and the fuel/air feedback signal to produce a system fuel/air command which results in minimal air/fuel perturbations under dynamic operating conditions over the complete range of canister charge state. An advantageous embodiment can use a vehicle onboard engine control computer.

In a typical purge system, purging is disabled under certain conditions such as cold engine operation and low engine airflow, such as at idle and during deceleration.

Figure 2:
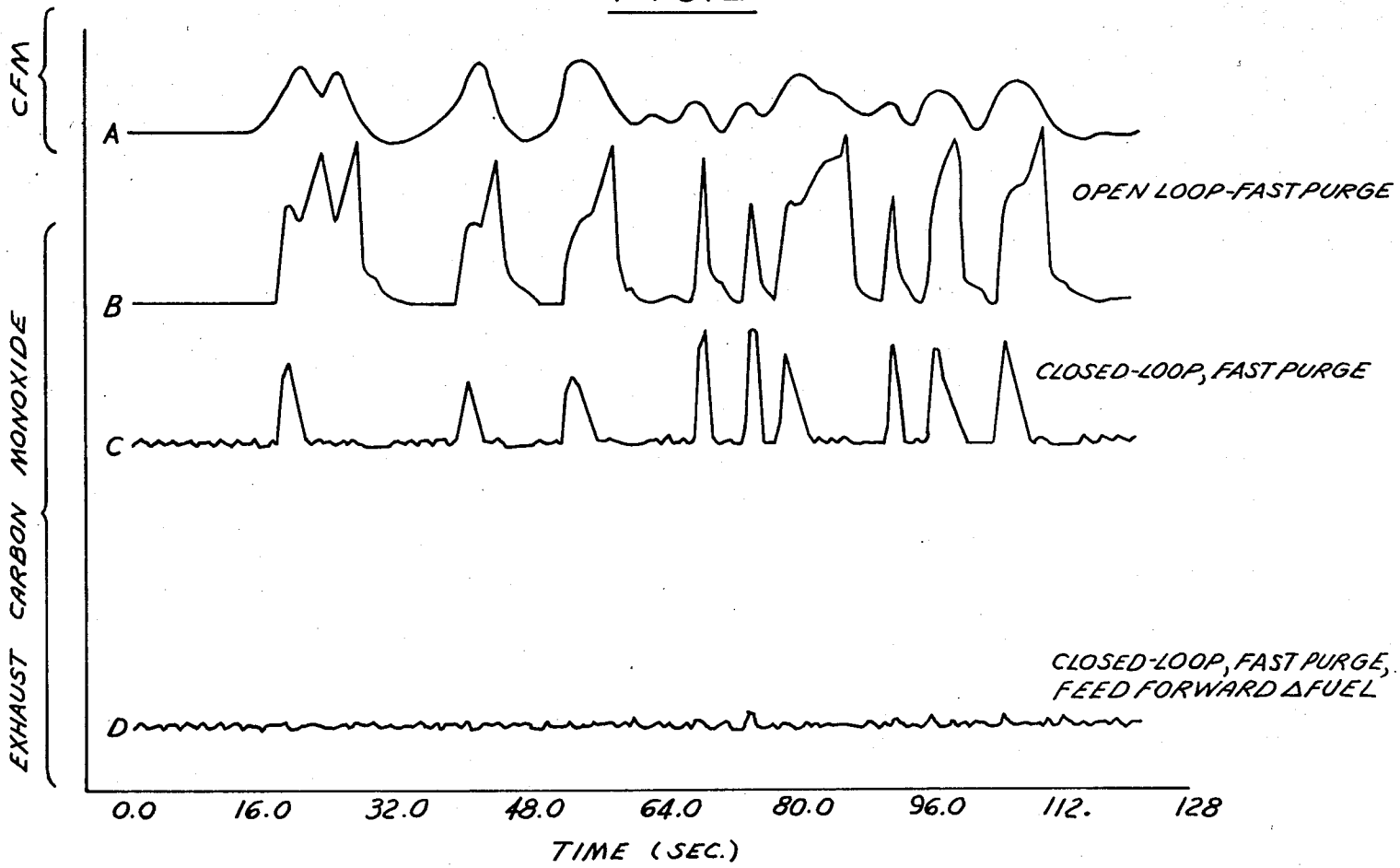
FIG. 2 is a graphical representation of airflow and exhaust carbon monoxide versus time for vapor fuel recovery control systems of the prior art and in accordance with an embodiment of this invention.

Referring to FIG. 2, line A shows the magnitude of a typical engine airflow versus time. Lines B through D show the magnitude of carbon monoxide versus time for various fuel vapor purge control systems. Line B shows carbon monoxide versus time for an open loop, fast purge system. Line C shows carbon monoxide versus time for a closed loop, fast purge system and shows an improvement in carbon monoxide control versus line B. Line D shows the magnitude of carbon monoxide versus time for a closed loop, fast purge, feedforward fuel control system in accordance with an embodiment of this invention. The magnitude of carbon monoxide control shown on line D is substantially improved with respect to lines B and C. The graphical representation shown in FIG. 2 is based on computer simulations for the first 128 seconds of the FTP CVS cycle, a standardized government testing procedure.

When the feedforward fuel signal is a function of the fuel level, the duty cycle of the signal applied to the canister purge valve advantageously is modulated so that the purge flow is proportional to the engine inlet airflow whenever purging is occurring. However, if the offsetting feedforward fuel command ($K_0$) is a function of engine airflow as well as canister charge state, it would not be necessary to duty cycle modulate the purge valve signal, and the purge valve could be opened fully whenever purging was occurring. In effect, such modification of the feedforward fuel signal transfers the problem of defining the purge valve duty cycle signal as a function of engine airflow to that of defining $K_0$ as a function of engine airflow (as well as fuel level). In accordance with the preceding description, a signal representing airflow is applied as indicated by dotted line inputs to block 14 and duty cycle generator 20.

Another modification to the invention disclosed herein is to vary the value of the fuel tank level signal (or, alternately, the value of $K_0$) so as to reflect the amount of time that the engine is not running. This can be done using a low cost, low power consumption timer which would be energized whenever the ignition was off. An input to block 14 supplying such time information is shown in dotted line in FIG. 1. Such a modification would account for the gradual build-up of vapors in the carbon canister which is known to occur when a vehicle with such a vapor recovery system is left unattended for extended periods of time. Since such a build-up of vapors will normally not be accompanied by a change in the level of fuel in the fuel tank, some means for compensating for the build-up is clearly required so that the value of $K_0$) can accurately represent an appropriate F/A correction.

Other modifications and variations will no doubt occur to those skilled in the arts to which this invention pertains. For example, a particular feedback sensor for engine control may be varied from that disclosed herein. These and all other variations which basically rely on the teachings through which this disclosure has advanced the art are properly considered within the scope of this invention.

I claim:

1. A method of controlling air/fuel ratio perturbation in response to purging of fuel vapors from a vapor canister storing fuel vapors from the fuel tank of an internal combustion engine including the steps of:

generating a base fuel command;

actuating purging of the fuel vapors; and feeding forward an offsetting fuel command signal to modify the base fuel command signal whenever fuel vapor purging is occurring in order to compensate for the fuel and air that enter the engine via the purge line thereby reducing air/fuel ratio perturbations.

2. A method of controlling air/fuel ratio perturbations in response to purging of fuel vapors as recited in claim 1 wherein said step of feeding forward an offsetting fuel command signal includes selecting the value of the offsetting fuel command signal to be approximately proportional to the amount of fuel vapors stored in the vapor canister.

3. A method of controlling air/fuel ratio perturbations in response to purging of fuel vapors as recited in claim 2 further comprising the step of sensing the quantity of fuel in the vehicle fuel tank to be used as an indication of the amount of fuel vapors stored in the vapor canister.

4. A method of controlling air/fuel ratio perturbations in response to purging of fuel vapors as recited in claim 3 further including the step of:

generating a purge command signal indicating when purge is on and off;

actuating a purge flow in response to an on purge command signal;

modulating the purge flow of an air and fuel vapor mixture from the vapor canister to the intake of the internal combustion engine by gradually changing the magnitude of a transient flow between no purge flow and a full purge flow so that the amount of combustion exhaust emissions can be controlled.

5. A method of controlling air/fuel ratio perturbations in response to purging of fuel vapors as recited in claim 4 wherein the step of modulation includes:

placing a solenoid control valve in the flow path from the vapor canister to the intake of the internal combustion engine;

selectively actuating the solenoid control valve with pulses fully opening the solenoid control valve; and changing the duty cycle of the actuating signal applied to the solenoid control valve to gradually change the magnitude of the average flow through said solenoid control valve.

6. A method of controlling air/fuel ratio perturbations in response to purging of fuel vapors as recited in claim 5 wherein the step of modulating the overall purge flow rate includes applying a variable duty cycle switching command to the solenoid purge valve to achieve the desired function between the overall purge flow rate from the vapor canister and the amount of fuel vapor stored in the vapor canister.

7. A method of controlling air/fuel perturbations in response to purging of fuel vapors as recited in claim 6 wherein the purge flow is modulated so as to be proportional to engine inlet airflow whenever purging is occurring.

8. A method of controlling air/fuel perturbations in response to purging of fuel vapors as recited in claim 7 further comprising selecting the value of the offsetting fuel commmand signal to be a function of the amount of time the engine is not running.

9. A method of controlling air/fuel ratio perturbations in response to purging of fuel vapors as recited in claim 2 further comprising selecting the value of the offsetting fuel command signal to be a function of engine airflow as well as approximately proportional to the amount of fuel vapors stored in the vapor canister.

10. A method of controlling air/fuel perturbations in response to purging of fuel vapors as recited in claim 9 further comprising selecting the value of the offsetting fuel command signal to be a function of the amount of time the engine is not running.

* * * * *